US011319845B1

(12) United States Patent
Lawrence et al.

(10) Patent No.: US 11,319,845 B1
(45) Date of Patent: May 3, 2022

(54) CRANKCASE VENTILATION SYSTEM

(71) Applicant: Caterpillar Inc., Peoria, IL (US)

(72) Inventors: Rodney A. Lawrence, Frankfort, IN (US); Nicholas E. Wainscott, Rossville, IN (US); Joshua A. Lehe, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/238,895

(22) Filed: Apr. 23, 2021

(51) Int. Cl.
*F01M 13/00* (2006.01)
*F01M 5/00* (2006.01)
*F02B 77/11* (2006.01)

(52) U.S. Cl.
CPC ..... *F01M 13/00* (2013.01); *F01M 5/001* (2013.01); *F02B 77/11* (2013.01); *F01M 2013/0027* (2013.01)

(58) Field of Classification Search
CPC ..... F01M 13/00; F01M 5/001; F01M 2013/0027; F01M 2013/0472; F02B 77/11
See application file for complete search history.

(56) References Cited

U.S. PATENT DOCUMENTS

| | | | | |
|---|---|---|---|---|
| 6,234,154 | B1 | 5/2001 | Spix | |
| 6,390,080 | B1 | 5/2002 | Dowding et al. | |
| 6,601,572 | B2 | 8/2003 | Okamoto | |
| 6,772,744 | B2 | 8/2004 | Nanno et al. | |
| 2006/0162325 | A1 * | 7/2006 | Darley | F01N 3/05 60/317 |

FOREIGN PATENT DOCUMENTS

| | | | |
|---|---|---|---|
| EP | 2667130 | A1 | 12/2013 |
| JP | 6476907 | B2 | 3/2019 |

* cited by examiner

*Primary Examiner* — Jacob M Amick
(74) *Attorney, Agent, or Firm* — Bookoff McAndrews PLLC

(57) ABSTRACT

A system for an engine includes a heat shield system and a crankcase ventilation system. The heat shield system includes at least one heat shield panel. The crankcase ventilation system includes at least one breather, at least one outlet, and at least one conduit extending from the at least one breather to the at least one outlet. A portion of the at least one conduit is coupled to the at least one heat shield panel to directly transfer heat from the heat shield system to the at least one conduit.

19 Claims, 4 Drawing Sheets

CRANKCASE VENTILATION SYSTEM

TECHNICAL FIELD

The present disclosure relates generally to crankcases for internal combustion engines, and more particularly, to a crankcase ventilation system to direct and heat blow-by fumes for such internal combustion engines.

BACKGROUND

Internal combustion engines typically include a crankcase to provide a housing for a crankshaft of the engine. During operation of the engine, blow-by gases or fumes (e.g., gaseous fuel, air, and/or combustion gases) may leak into the crankcase. Blow-by fumes may contaminate an oil lubricating system of the engine, may pressurize the crankcase, and may affect overall engine emissions. Further, if the engine employs gaseous fuel (e.g., natural gas or landfill gas) as a fuel source, the blow-by fumes may include corrosive gases, such as sulfur. The crankcase may include a ventilation system, such as an inlet/outlet breather system, to help purge the blow-by fumes from the crankcase using fresh ambient air. When the engine is used in colder environments, the ambient air used in the ventilation system may be so cold that condensation (e.g., water) forms in the crankcase. The condensation may combine with the corrosive gases, which may then form harmful acids in the crankcase.

Many crankcase ventilation systems include conduits that route blow-by fumes from one point to another. The blow-by fumes often have low thermal energy, a significant amount of water vapor included in the blow-by fumes, and a high dew point temperature. As such, managing the temperature of the blow-by gas may help minimize condensation, the formation of an oil-water emulsion, water or other liquids freezing, and other issues in conduits, especially in colder environments. Many crankcase ventilation systems use low thermal conductivity conduit materials, insulation, and/or supplemental heaters to help minimize these potential issues. Moreover, conduits that route blow-by fumes horizontally and/or vertically also pose the risk of condensation draining back to the crankcase or otherwise against the flow of the blow-by gas, for example, risking contamination of the engine lubrication oil.

Japanese Patent No. JP6476907B2, issued on Mar. 6, 2019 ("the '907 patent), describes a ventilation system for a crankcase of an internal combustion engine. The '907 patent discloses a blow-by gas pipe antifreeze structure that includes a number of pipes to route the blow-by gas. The blow-by gas pipe antifreeze structure also includes a heat receiving passage for heating the blow-by gas, with the heat receiving passage positioned in a cylinder head cover. The pipes of the blow-by gas pipe antifreeze structure are coupled to the heat receiving passage such that the blow-by gases in the pipes of the blow-by gas pipe antifreeze structure pass through the heat receiving passage, warming the gases and helping to prevent the gases from freezing. However, the blow-by gas pipe antifreeze structure of the '907 patent requires routing blow-by gas pipes through a connection to the cylinder head cover, which may interfere with other components of the engine, require additional piping to extend to and from the cylinder head cover, or may otherwise impair the use or operation of the engine.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, a system for an engine may include a heat shield system and a crankcase ventilation system. The heat shield system may include at least one heat shield panel. The crankcase ventilation system may include at least one breather, at least one outlet, and at least one conduit extending from the at least one breather to the at least one outlet. A portion of the at least one conduit may be coupled to the at least one heat shield panel to directly transfer heat from the heat shield system to the at least one conduit.

In another aspect, a method for ventilating a crankcase of an internal combustion engine may include coupling an inlet of a first portion of a conduit to a breather of the crankcase, coupling a duct portion of the conduit to a heat shield panel on the engine such that a portion of the heat shield panel may form a planar wall of the duct portion, and coupling an outlet of the first portion of the conduit to an inlet of the duct portion of the conduit. The method may also include coupling an outlet of the duct portion of the conduit to an inlet of a second portion of the conduit, and coupling an outlet of the second portion of the conduit to an outlet conduit, such that blow-by fumes from the breather may be directed through the first portion of the conduit, the duct portion of the conduit, the second portion of the conduit, and the outlet conduit. The blow-by fumes within the duct portion of the conduit may be heated by heat dissipated by the heat shield panel.

In yet another aspect, a crankcase ventilation system for an internal combustion engine may include a heat shield system and a crankcase ventilation system. The heat shield system may include at least one heat shield panel. The crankcase ventilation system may include at least one breather, at least one outlet, and at least one conduit extending from the at least one breather to the at least one outlet. The at least one conduit may include a first portion, a duct portion, and a second portion. The duct portion of the at least one conduit may abut the at least one heat shield panel such that blow-by fumes in the duct portion of the at least one conduit may be heated by heat dissipated by the at least one heat shield panel.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
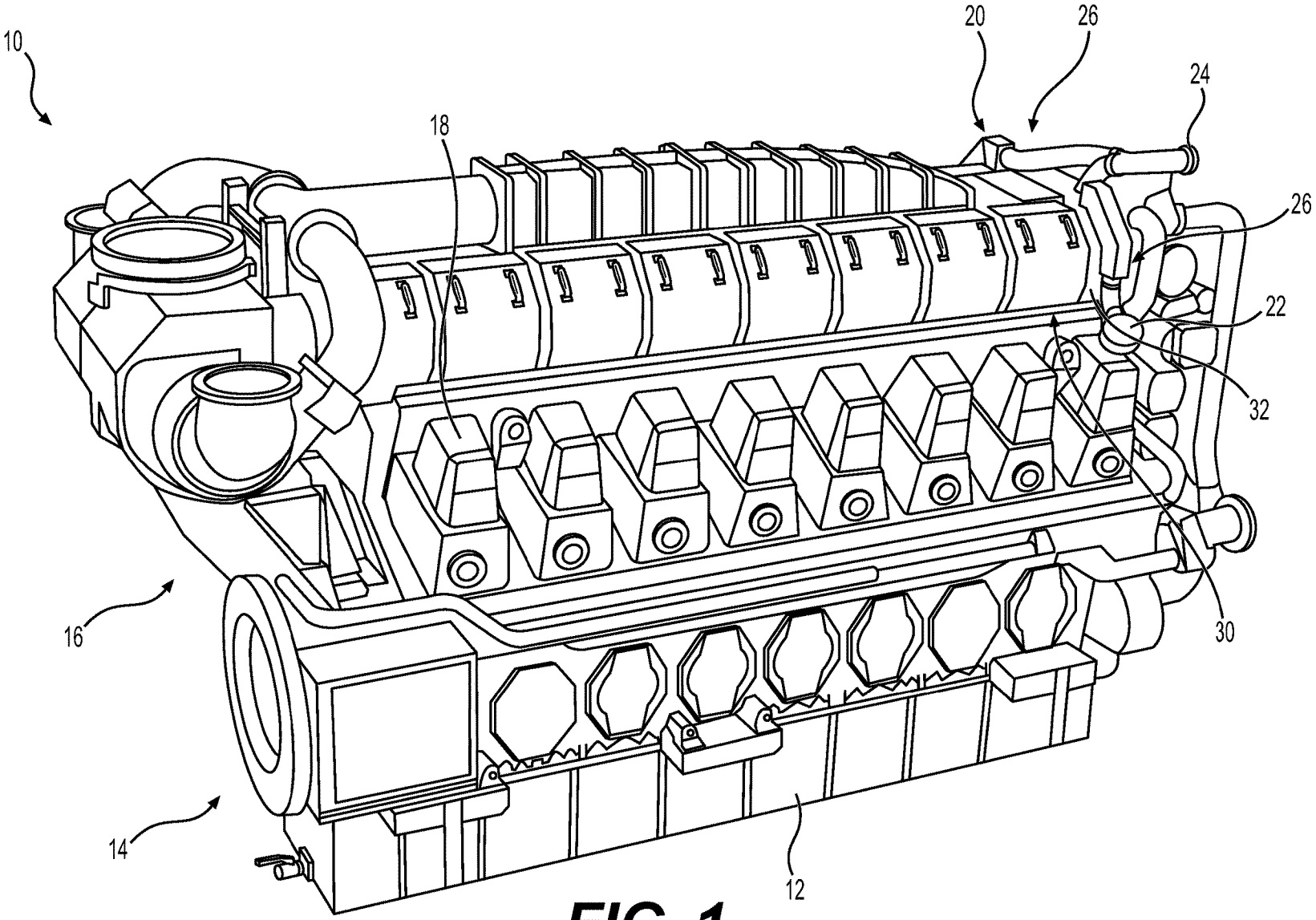
FIG. 1 is a perspective view of an internal combustion engine having an exemplary crankcase ventilation system, according to aspects of the disclosure.

FIG. 1 is a perspective view of an internal combustion engine 10 having an exemplary crankcase ventilation system 20, according to aspects of the disclosure. Engine 10 may be a stationary engine. As used herein, a "stationary engine" may be an engine with a framework that does not move. Stationary engines may be used to drive immobile equipment, such as pumps, generators, mills, or factory equipment. In one embodiment, engine 10 may be used in landfill applications for generating electricity. As such, engine 10 may employ gaseous fuel. As used herein, "gaseous fuel" may include fuel that is supplied to engine 10 in gaseous form. Gaseous fuel may include, for example, natural gas, propane, bio-gas, landfill gas, associated gas, carbon monoxide, hydrogen, or mixtures thereof. In an exemplary embodiment, the gaseous fuel may be a natural gas, such as associated gas. Natural gas is an exemplary gaseous fuel having various levels of purity. As used herein, "natural gas" refers to both pure and relatively impure forms having various amounts of methane and other constituents. Further, as used herein, "associated gas" is a form of natural gas including deposits of petroleum. While the exemplary embodiment is directed to stationary engines, it is understood that engine 10 may also be used in mobile applications (i.e., non-stationary) and may employ any type of fuel.

As shown in FIG. 1, engine 10 include a frame 12. Frame 12 may support various components of engine 10, such as a crankcase 14, an engine block 16, and one or more cylinder heads 18 for one or more cylinders (not shown). Engine 10 may include any number of cylinders arranged in any configuration such as inline, radial, "V," or any configuration known in the art. Frame 12 may further support a fuel system, an air system, a cooling system, a turbocharger, or any other conventional engine components. Additionally, engine 10 includes a crankcase ventilation system 20. Crankcase ventilation system 20 includes at least one breather 22 and at least one outlet 24. The at least one breather 22 may be connected to outlet 24 via one or more conduits 26. The at least one breather 22 may include an inlet portion and an outlet portion. The inlet portion may be in communication with crankcase 14, and may draw in ambient air, for example, to help purge blow-by gases or fumes from crankcase 14. The outlet portion may be coupled to conduit 26 to output the blow-by gases or otherwise direct the blow-by gases away from engine 10. As discussed below, a plurality of conduits 26 may connect one breather 22 to outlet 24, and outlet 24 may be positioned above (e.g., relative to a direction of gravity) the at least one breather 22, for example, to route blow-by fumes up and away from engine 10.

During operation of engine 10, blow-by gases may leak into crankcase 14. As used herein, "blow-by" gases or fumes may include leakage of air, fuel, combustion gases and/or a mixture thereof between a piston (not shown) and a cylinder wall of one or more of the cylinders into the crankcase 14. When gaseous fuel is used as a fuel source for engine 10, blow-by gases may include, for example, sulfur or the like. Crankcase 14 may include crankcase ventilation system 20, which may be configured to purge the blow-by gases from crankcase 14. Crankcase ventilation system 20 may be an inlet/outlet breather system for purging blow-by gases from crankcase 14. In one embodiment, crankcase ventilation system 20 may be a non-ingestive ventilation system. As used herein, a "non-ingestive ventilation system" vents the blow-by gases out of the engine (e.g., to atmosphere). As such, crankcase ventilation system 20 may include an inlet for directing ambient air into crankcase 14 and outlet 24 for exhausting the blow-by gases from crankcase 14 and out of engine 10 to the atmosphere. Although not shown, crankcase ventilation system 20 may include one or more pumps, fans, etc. to direct air, blow-by gases, etc. from the inlet toward outlet 24. Thus, the vented blow-by gases may not be reintroduced to the combustion process of engine 10. Outlet 24 or one or more portions of conduits 26 may include a filtration system to filter the blow-by gases prior to exiting outlet 24. It is understood that crankcase ventilation system 20 may include any number of inlets and/or outlets, as necessary.

Engine 10 also includes a heat shield system 30 with at least one heat shield panel 32. Heat shield system 30 may help to insulate engine 10, for example, when operating in cold environments, and/or dissipate heat from one or more portions of engine 10, for example, to help prevent overheating. Although not labeled, heat shield system 30 may include additional heat shield portions, for example, around one or more portions of engine 10 to form a larger heat shield or insulation system to help insulate engine 10 and retain heat, especially in colder environments. As shown in FIG. 1, at least a portion of the one or more conduits 26 may be at least partially directly attached to, integrated within, enclosed in, surrounded by, in abutting contact, or otherwise coupled to a portion of the at least one heat shield panel 32. One or more portions of heat shield system 30, for example, heat shield panel 32, may be formed of a hard, insulating material, for example, a steel (e.g., a stainless steel), aluminum, ceramic, etc.

Figure 2:
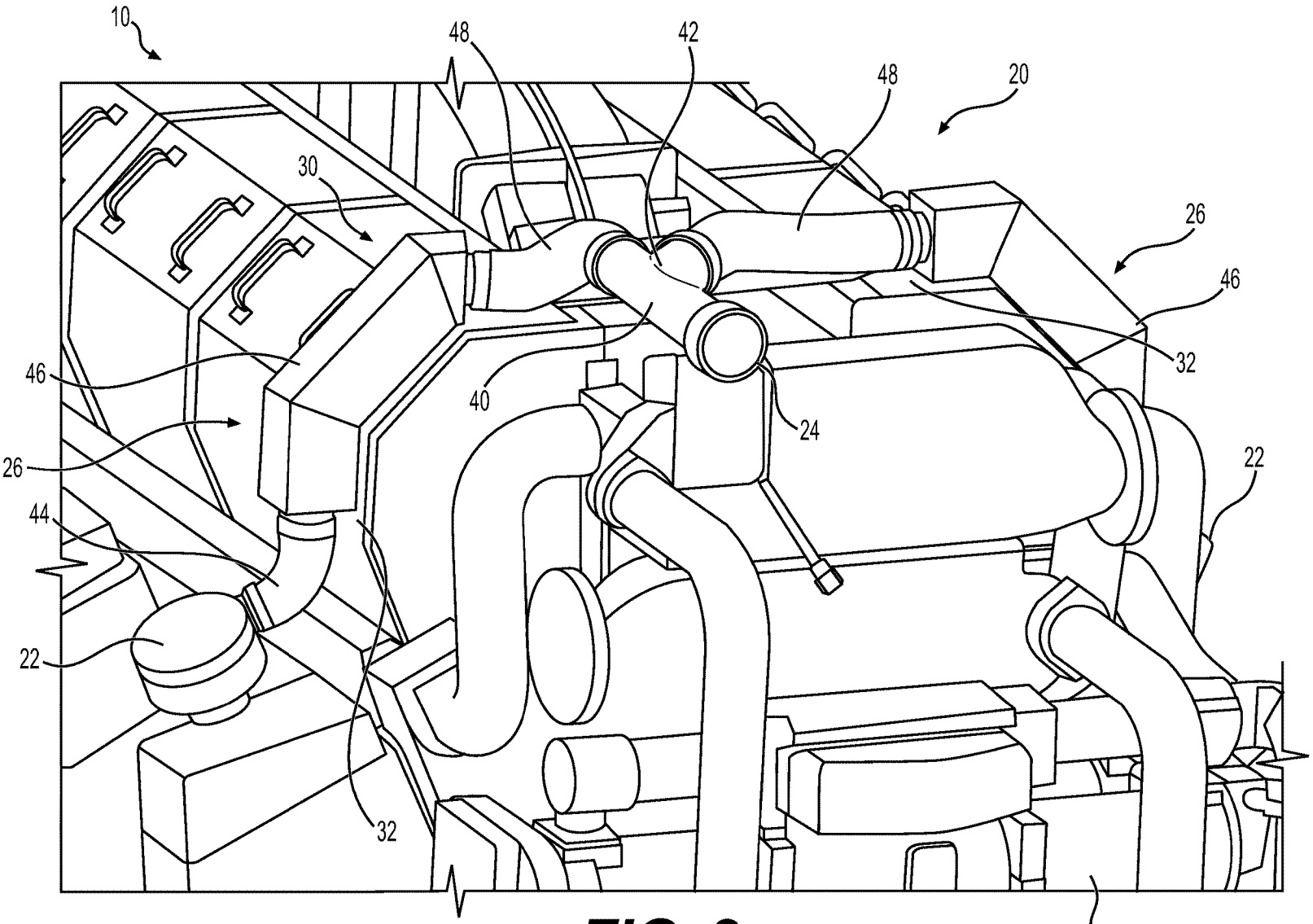
FIG. 2 is a perspective view of a blow-by fume disposal system of the internal combustion engine of FIG. 1.

FIG. 2 is a perspective view of a portion of engine 10 (i.e., from the right side of FIG. 1). FIG. 2 illustrates portions of crankcase ventilation system 20 and heat shield system 30 coupled to engine 10. As shown in FIG. 2, engine 10 may include two breathers 22, for example, positioned on opposite sides of engine 10 (e.g., relative to a longitudinal axis). Each breather 22 may be coupled to a respective conduit 26. Additionally, heat shield system 30 may include two heat shield panels 32. Each conduit 26 may be at least partially directly attached to, integrated within, enclosed in, surrounded by, in abutting contact, or otherwise coupled to a portion of a respective at least one heat shield panel 32. It is noted, however, that if engine 10 includes more than two breathers 22, then crankcase ventilation system 20 and heat shield system 30 may include more than two conduits 26 and heat shield panels 32, respectively. For example, in one aspect, engine 10 may include sixteen breathers 22, for example, eight breathers 22 on each side of engine 10. In this aspect, engine 10 may include 16 conduits 26 coupling each breather 22 to outlet 24, with portions of each of the conduits 26 coupled to one or more heat shield panels.

Additionally, conduits 26 may be coupled to an outlet conduit 40. For example, outlet conduit 40 may include a forked portion 42 with two inlets to be coupled to portions of respective conduits 26. Outlet conduit 40 also includes outlet 24, which may form a customer connection point, for example, to be coupled to an outlet tube, exhaust hose, or other conduit to carry the blow-by fumes away from engine 10. It is noted that, if crankcase ventilation system 20 includes more than two conduits 26, then outlet conduit 40 may include more than two inlets, for example, formed by a forked portion with more than two branches, a plurality of forked portions, etc.

As shown in FIG. 2, conduits 26 may each include one or more portions or sections. For example, conduits 26 may each include a first conduit portion 44, a duct portion 46, and a second conduit portion 48. A first end of first conduit portion 44 may be coupled to breather 22, and a second end of first conduit portion 44 may be coupled to a first end of duct portion 46. As mentioned, a portion of duct portion 46 may be at least partially directly attached to, integrated within, enclosed in, surrounded by, in abutting contact, or otherwise coupled to a portion of heat shield panel 32. A second end of duct portion 46 may be coupled to a first end of second conduit portion 48. A second end of second conduit portion 48 may then be coupled to outlet conduit 40, for example, to one inlet of forked portion 42 of outlet conduit 40. First conduit portion 44 and second conduit portion 48 may be formed by hoses, tubes, or other appropriate elements to fluidly couple breathers 22 to outlet conduit 40. Furthermore, duct portion 46 may be formed of sheet metal, piping, or other appropriate elements. In these aspects, conduits 26 may direct blow-by fumes from breathers 22 to outlet conduit 40 and outlet 24. Additionally, although not shown, the couplings between breathers 22, portions of conduits 26, and outlet conduit 40 may include one or more threadings, seals, clamps, etc. to couple the respective components and prevent blow-by fumes from escaping.

Figure 3:
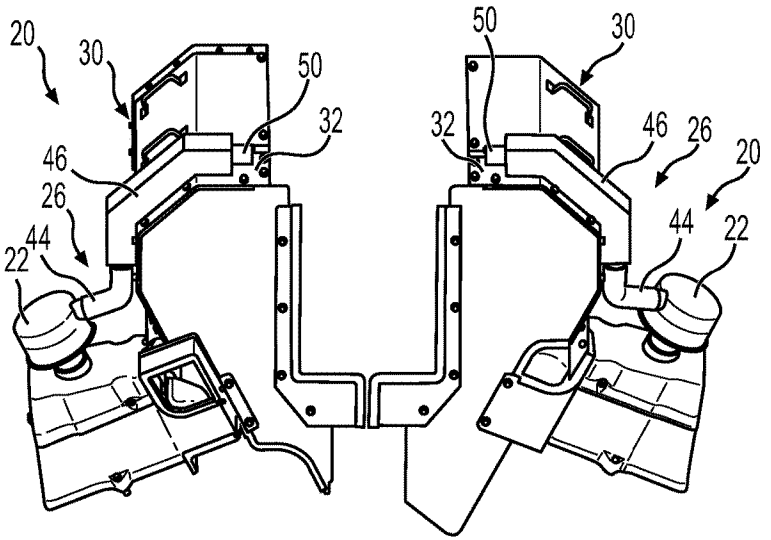
FIG. 3 is a perspective view of a section of the blow-by fume disposal system coupled to a portion of a heat shield system, isolated from the remainder of the internal combustion engine of FIG. 1.

FIG. 3 illustrates portions of crankcase ventilation system 20 and heat shield system 30 separated from the rest of the engine. In this aspect, one or more portions of crankcase ventilation system 20 and heat shield system 30 may be modular, and may be coupled to the engine. As shown, conduits 26, for example, first conduit portions 44, may be coupled to breathers 22. First conduit portions 44 may be coupled to duct portions 46, which may be coupled to the second conduit portions (not shown). Additionally, duct portions 46 may be at least partially directly attached to, integrated within, enclosed in, surrounded by, in abutting contact, or otherwise coupled to a portion of a respective at least one heat shield panel 32. Duct portions 46 may each include duct outlets 50, for example, to be coupled to respective inlets of second conduit portion 48 (FIG. 2).

Figure 4A:
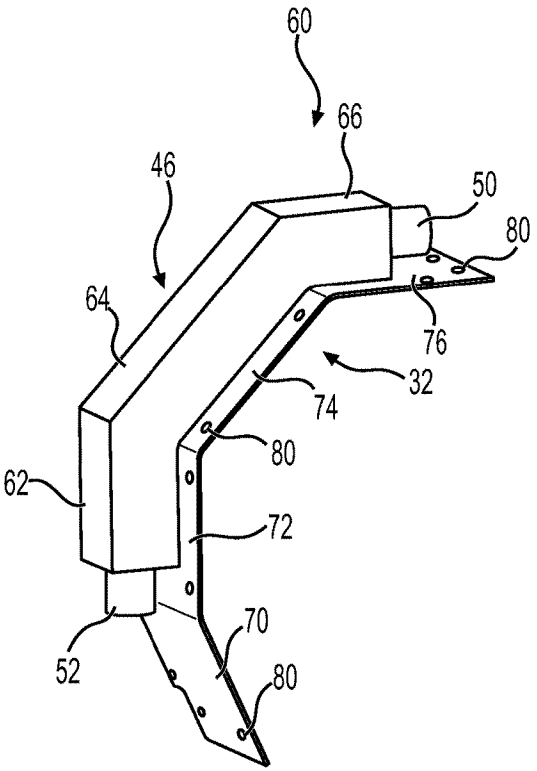
FIGS. 4A and 4B illustrate different views of a portion of the blow-by fume disposal system and a portion of a heat shield system.
Figure 4B:
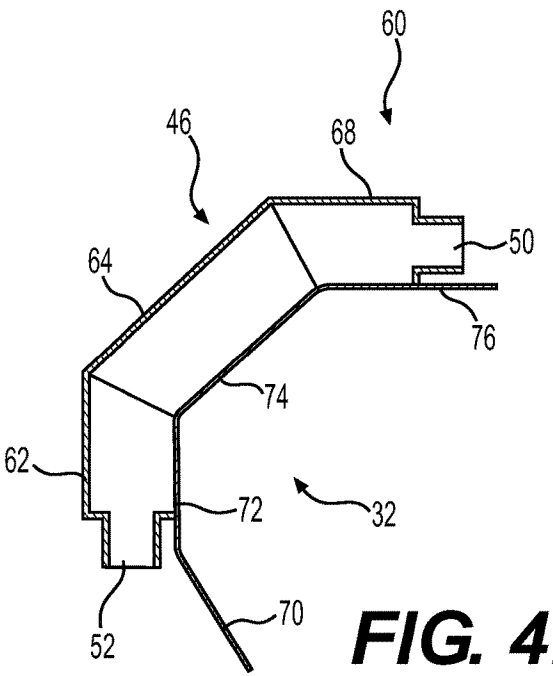

FIG. 4A illustrates a perspective view of heat shield panel 32 and duct portion 46 of the conduit, for example, coupled together as a single combined component 60. FIG. 4B illustrates a cross-sectional view of combined component 60, including heat shield panel 32 and duct portion 46. As shown, duct portion 46 may include duct outlet 50 and a duct inlet 52. Duct inlet 52 may be coupled to an outlet of first conduit portion 44 (FIGS. 2 and 3). Although not shown, duct outlet 50 and duct inlet 52 may each include a threading, one or more seals, one or more clamps, etc., for example, to help securely couple conduit portions 44 and 48 to duct outlet 50 and duct inlet 52.

Duct portion 46 may include one or more portions or segments, for example, positioned at angles relative to each other. In this aspect, a first portion 62 of duct portion 46 may be approximately vertical, for example, relative to a vertical axis of engine 10. A second portion 64 of duct portion 46 may be at an angle to first portion 62, for example, approximately 45 degrees. A third portion 66 of duct portion 46 may be approximately horizontal, for example, approximately 45 degrees relative to second portion 64.

Heat shield panel 32 may also include one or more portions or segments, for example, positioned at angles relative to each other. Additionally, heat shield panel 32 may be sized and/or shaped to be coupled to an exterior of engine 10. For example, heat shield panel 32 may include a plurality of sections positioned at angles relative to adjacent sections. In this aspect, heat shield panel 32 may include a first section 70, which may be positioned at an angle (e.g., approximately 45 degrees) relative to a vertical axis, for example, relative to the vertical axis of engine 10. Heat shield panel 32 may include a second section 72, which may be at an angle relative to first section 70, for example, approximately 45 degrees. Second section 72 may be approximately vertical. Heat shield panel 32 may also include a third section 74, which may be at an angle relative to second section 72, for example, approximately 45 degrees. Moreover, heat shield panel 32 may also include a fourth section 76, which may be at an angle relative to third section 74, for example, approximately 45 degrees. In this aspect, fourth section 76 may be approximately horizontal. Furthermore, one or more portions of heat shield panel 32 may include holes 80, for example, to receive screws, bolts, etc. to couple heat shield panel 32 to other portions of heat shield system 30 or to other portions of engine 10.

As shown in FIG. 4B, the passageway through the internal portion of duct portion 46 is formed by the outer walls of duct portion 46 and an outer surface of heat shield panel 32. Specifically, the portion of conduit 26 formed by duct portion 46 does not include a tube or hose within duct portion 46. Additionally, one or more portions of heat shield panel 32 may form one or more walls of the passageway through duct portion 46. In this aspect, the walls of duct portion may be directly attached to, integrally formed with, in abutting contact, or otherwise coupled to heat shield panel 32. Moreover, the portion of heat shield panel 32 that forms a portion of the passageway through duct portion 46 may be substantially planar. In this aspect, heat shield panel 32 may form a planar surface area, over which air, blow-by fumes, etc. may directly flow. The planar surface of heat shield panel 32 may help to form a large contact surface, for example, to transfer heat from heat shield panel 32 to the air, blow-by fumes, etc. As mentioned, the transfer of heat from heat shield panel 32 to the air, blow-by fumes, etc. may help prevent the formation of condensation, the formation of an oil-water emulsion, water or other liquids freezing, and other issues in conduits 26.

Heat shield panel 32 and duct portion 46 may be coupled together (e.g., via one or more screws, bolts, welds, adhesives, etc.) or may be integrally formed. Furthermore, heat shield panel 32 may also transfer heat to the other walls of duct portion 46, which may, in turn, transfer heat to the air, blow-by fumes, etc. flowing through duct portion 46. In another aspect, a conduit, tube, etc. (not shown) may connect duct inlet 52 and duct outlet 50 on the interior of duct portion 46. In any of these aspects, blow-by fumes or other gases passing through duct portion 46 may be warmed by the warmth of engine 10 that is retained or dissipated by heat shield panel 32 and the rest of heat shield system 30. Additionally, the size and/or shape of heat shield panel 32 and duct portion 46, and thus combined component 60, may be configured to couple heat shield panel 32 and duct portion 46 to one or more portions of engine 10, for example, retrofitting portions of crankcase ventilation system 20 and heat shield system 30 to engine 10.

Figure 5:
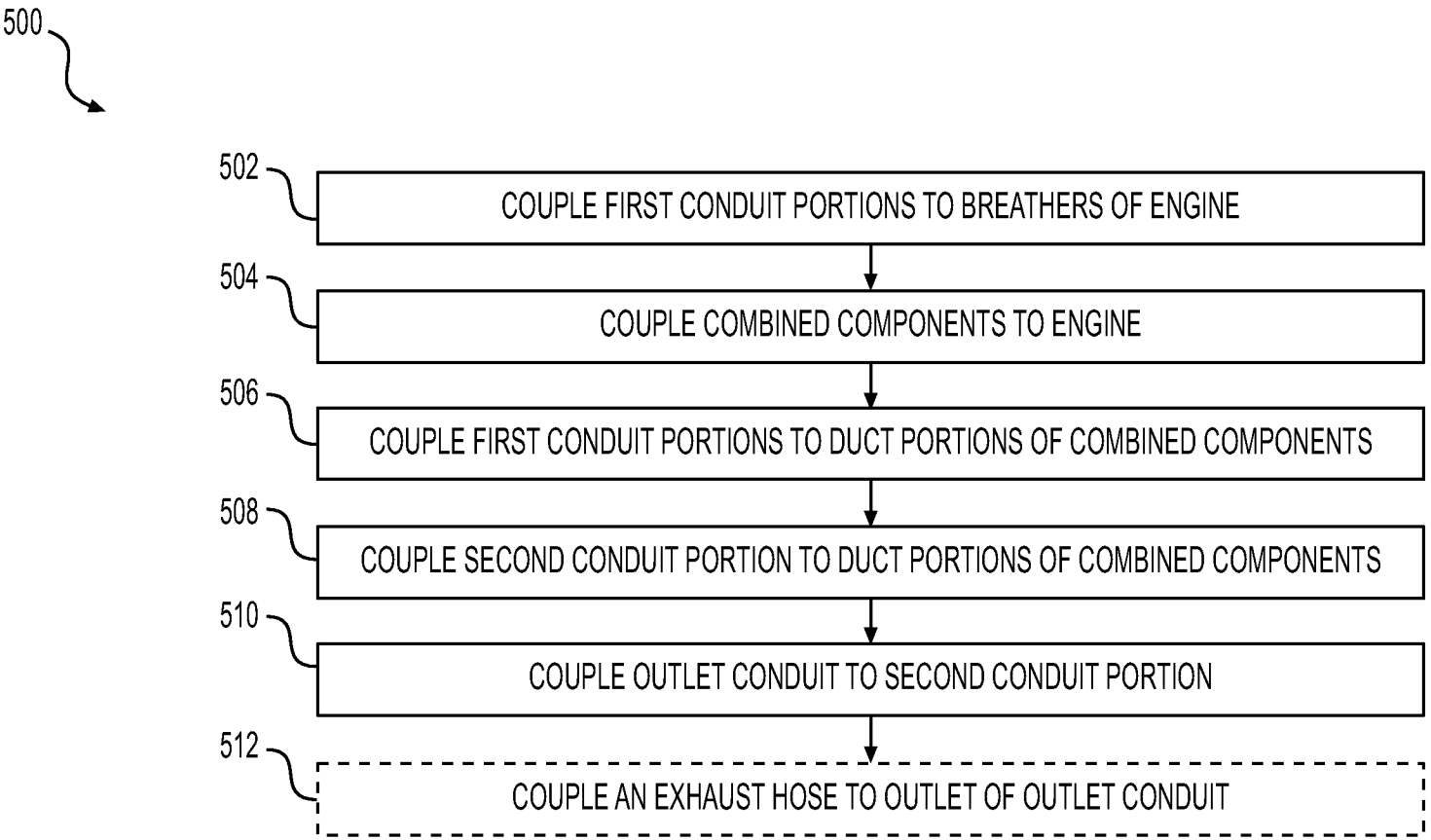
FIG. 5 provides a flowchart depicting an exemplary method of coupling portions of ventilation and heat shield systems to the internal combustion engine of FIG. 1.

Referring to FIG. 5, a method 500 may be performed to couple the aforementioned portions of crankcase ventilation system 20 and at least a portion of heat shield system 30 to engine 10. For example, method 500 may be performed to help direct blow-by fumes from breathers 22 away from engine 10, for example, via outlet 24, while also helping to heat conduits 26 and the blow-by fumes within conduits 26.

A first step 502 includes include coupling first conduit portions 44 to breathers 22 of engine 10. As mentioned, coupling first conduit portions 44 to breathers 22 may include one or more one or more seals, one or more clamps, etc. In this aspect, blow-by fumes from breathers 22 may be directed into first conduit portions 44.

Next, a step 504 includes coupling combined components 60, including duct portions 46 and heat shield panels 32, to engine 10. For example, one or more screws, bolts, etc. may be inserted through holes 80 and into coupling portions of engine 10 to coupling each combined component 60, including duct portion 46 and heat shield panel 32, to engine 10. Furthermore, if duct portion 46 and heat shield panel 32 are not integrally formed, step 504 may also include coupling duct portion 46 to heat shield panel 32, for example, via one or more screws, bolts, welds, adhesives, etc. Alternatively, as discussed above, duct portion 46 and heat shield panel 32 may be integrally formed.

A step 506 includes coupling first conduit portions 44 to duct portions 46, for example, to duct inlet 52 of combined components 60. For example, if duct portions 46 are secured to engine 10, first conduit portions 44 may be flexible. Alternatively or additionally, steps 504 and 506 may be performed simultaneously. As mentioned, coupling first conduit portions 44 to duct portions 46 may include one or more one or more seals, one or more clamps, etc. In this aspect, blow-by fumes from breathers 22 may be directed into first conduit portions 44 and into duct portions 46.

Next, a step 508 includes coupling second conduit portions 48 to duct portions 46, for example, to duct outlet 50. As mentioned, coupling second conduit portions 48 to duct portions 46 may include one or more one or more seals, one or more clamps, etc. In this aspect, blow-by fumes from breathers 22 may be directed into first conduit portions 44, into duct portions 46, and into second conduit portions 48.

A step 510 includes coupling outlet conduit 40 to second conduit portions 48. For example, if outlet conduit 40 is secured to engine 10, second conduit portions 48 may be flexible. Alternatively or additionally, steps 508 and 510 may be performed simultaneously. For example, forked portion 42 of outlet conduit 40 may be coupled to outlet ends of second conduit portions 48. Coupling outlet conduit 40 to conduit portions 48 may include one or more one or more seals, one or more clamps, etc. In this aspect, blow-by fumes from breathers 22 may be directed into first conduit portions 44, into duct portions 46, into second conduit portions 48, and into outlet conduit 40.

Optionally, a step 512 includes coupling an exhaust hose or conduit to outlet 24 of outlet conduit 40 to further convey the blow-by fumes away from engine 10. Coupling the exhaust hose or conduit to outlet 24 may include one or more one or more seals, one or more clamps, etc. In this aspect, blow-by fumes from breathers 22 may be directed into first conduit portions 44, into duct portions 46, into second conduit portions 48, into outlet conduit 40, out of outlet 24, and into the exhaust hose or conduit to be directed away from engine 10. Furthermore, it is noted that steps 502-510, and optionally step 512, may be performed in any order in order to form a flow path for blow-by fumes from breathers 22 to outlet 24.

INDUSTRIAL APPLICABILITY

The disclosed crankcase ventilation system 20 and heat shield system 30 of the present disclosure may be used with a crankcase 14 of any internal combustion engine 10. As discussed above, in some aspects, crankcase ventilation system 20 and heat shield system 30 may be used with crankcase 14 of a stationary engine. Additionally, crankcase ventilation system 20 includes one or more conduits 26 to direct the blow-by gas for removal from engine 10. Portions of the one or more conduits 26 are at least partially directly attached to, integrated within, enclosed in, surrounded by, in abutting contact, or otherwise coupled to one or more portions of heat shield system 30, for example, to heat shield panel 32.

Coupling portions of the one or more conduits 26 to one or more portions of heat shield system 30 may provide a simple routing for blow-by fumes, for example, from breathers 22. Conduits 26 do not require a separate support system. Conduits 26 and heat shield panels 32 may be modular components (e.g., combined component 60), which may be coupled to portions of engine 10 as needed. Additionally, there is not a need for an operator to mount additional hoses or tubes to direct the blow-by fumes from breathers 22 to outlet 24, which may increase the number of components of engine 10, interfere with other components or systems of engine 10, require knowledge of the operation of engine 10, negatively affect the overall appearance of engine 10, etc. Crankcase ventilation system 20 is positioned adjacent to engine 10, so there may also be a reduced likelihood of other engine components (e.g., other tubes, hoses, etc.) interfering with crankcase ventilation system 20.

Furthermore, coupling portions of the one or more conduits 26 to one or more portions of heat shield system 30 may help to heat the blow-by fumes within conduits 26. As discussed above, when engines are used in colder environments, the ambient air used in the ventilation system may be so cold that condensation (e.g., water) may form in the crankcase. The condensation may combine with the corrosive gases, which may then form harmful acids in the crankcase. Conduits 26, including duct portions 46, are coupled to portions of heat shield system 30, for example, to heat shield panels 32. Accordingly, heat from engine 10 that is dissipated through heat shield system 30 may also dissipate through duct portions 46, and help to warm conduits 26 and the air, blow-by fumes, etc. within conduits 26, without the need for additional insulation, heat sources, etc. As a result, aspects of engine 10 discussed herein may help to reduce temperature loss of air, blow-by fumes, etc. within conduits 26, which may help to reduce the risk of condensation forming in conduits 26, an oil-water emulsion forming in conduits 26, and/or fluid freezing in conduits 26.

Moreover, the length or size of duct portion 46 may be adjusted (e.g., lengthened or shortened) in order to control the exposure of the blow-by fumes to heat from heat shield system 30. For example, a longer duct portion 46 may heat the blow-by fumes in crankcase ventilation system 20 to a greater extent than a shorter duct portion 46. In this aspect, the heating of the blow-by fumes from heat retained within heat shield system 30 may be controlled, without the need for additional insulation, heat sources, etc.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for an engine, comprising:

a heat shield system, including at least one heat shield panel; and a crankcase ventilation system, including at least one breather, at least one outlet, and at least one conduit extending from the at least one breather to the at least one outlet, the at least one conduit including a duct portion and wherein the duct portion is coupled to the at least one heat shield panel such that the at least one heat shield panel forms a wall of the duct portion so air flowing through the duct portion contacts the at least one heat shield panel.

2. The system of claim 1, wherein the at least one conduit also includes a first conduit portion fluidly connected to the duct portion and a second conduit portion fluidly connected to the duct portion.

3. The system of claim 2, wherein the duct portion includes a first duct portion, a second duct portion at an angle relative to the first duct portion, and a third duct portion at an angle to the second duct portion.

4. The system of claim 3, wherein the at least one heat shield panel includes a plurality of sections adjacent to the first, second, and third duct portions of the duct portion, and wherein the plurality of sections of the at least one heat shield panel form planar walls of the first, second and third duct portions.

5. The system of claim 1, wherein the duct portion is integrally formed with the at least one heat shield panel.

6. A heat system for an engine, comprising:

a heat shield system, including first and second heat shield panels; and a crankcase ventilation system, including first and second breathers, an outlet, a first conduit extending from the first breather to the outlet, a second conduit extending from the second breather to the outlet, wherein a portion of the first conduit is coupled to the first heat shield panel to directly transfer heat from the first heat shield panel to the first conduit and a portion of the second conduit is coupled to the second heat shield panel to directly transfer heat from the second heat shield panel to the second conduit; and wherein the two breathers are positioned on opposite sides of the engine.

7. The system of claim 6, wherein the first and second conduits are coupled to an outlet conduit via a forked portion of the outlet conduit.

8. The system of claim 1, wherein the at least one outlet is positioned above the at least one breather.

9. A method for ventilating a crankcase of an internal combustion engine, comprising:

coupling an inlet of a first portion of a conduit to a breather of the crankcase;

coupling a duct portion of the conduit to a heat shield panel on the engine such that a portion of the heat shield panel forms a planar wall of the duct portion;

coupling an outlet of the first portion of the conduit to an inlet of the duct portion of the conduit;

coupling an outlet of the duct portion of the conduit to an inlet of a second portion of the conduit; and coupling an outlet of the second portion of the conduit to an outlet conduit, such that blow-by fumes from the breather are directed through the first portion of the conduit, the duct portion of the conduit, the second portion of the conduit, and the outlet conduit, wherein the blow-by fumes within the duct portion of the conduit are heated by heat from the heat shield panel.

10. The method of claim 9, further comprising:

coupling an exhaust hose to an outlet of the outlet conduit.

11. The method of claim 9, wherein the duct portion of the conduit and the heat shield panel are integrally formed.

12. The method of claim 9, wherein the duct portion wherein the duct portion includes a first portion, a second portion at an angle relative to the first portion, and a third portion at an angle to the second portion.

13. The method of claim 12, wherein the heat shield panel includes a plurality of sections adjacent to the first, second, and third portions of the duct portion that form internal planar walls of the duct portion.

14. The method of claim 9, wherein the outlet of the outlet conduit is positioned above the breather.

15. The method of claim 9, wherein the blow-by fumes include natural gas and at least one of air, fuel, or combustion gases.

16. The method of claim 9, wherein the engine is a stationary engine.

17. A crankcase ventilation system for an internal combustion engine, comprising:

a heat shield system, including first and second heat shield panels; and a crankcase ventilation system, wherein the crankcase ventilation system includes:

a first breather and a second breather, the first and second breathers being positioned on opposite sides of the internal combustion engine;

an outlet conduit including a forked portion, the outlet conduit being fluidly coupled to an outlet; and first and second conduits, the first conduit extending from the first breather to the forked portion of the outlet conduit, the second conduit extending from the second breather to the forked portion of the outlet conduit, wherein each of the first and second conduits includes a first conduit portion, a duct portion, and a second conduit portion, wherein the duct portion of the first conduit abuts the first heat shield panel such that blow-by fumes in the duct portion of the first conduit are heated by heat from the first heat shield panel and the duct portion of the second conduit abuts the second heat shield panel such that blow-by fumes in the duct portion of the second conduit are heated by heat from the second heat shield panel.

18. The system of claim 17, wherein the duct portion of each of the first and second conduits is integrally formed with the first and second heat shield panels, respectively.

19. The system of claim 17, wherein the engine is a stationary engine wherein the at least one outlet is positioned above the breathers.

* * * * *